US010508871B2

(12) United States Patent
Satake et al.

(10) Patent No.: US 10,508,871 B2
(45) Date of Patent: Dec. 17, 2019

(54) REFRIGERANT DISTRIBUTOR, AND HEAT PUMP DEVICE HAVING THE REFRIGERANT DISTRIBUTOR

(71) Applicant: Mitsubishi Electric Corporation, Tokyo (JP)

(72) Inventors: Yoshihiko Satake, Tokyo (JP); Nobuaki Miyake, Tokyo (JP); Yuudai Morikawa, Tokyo (JP); Akio Murata, Tokyo (JP); Hiroshi Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 249 days.

(21) Appl. No.: 15/314,676

(22) PCT Filed: Mar. 30, 2015

(86) PCT No.: PCT/JP2015/059983
§ 371 (c)(1),
(2) Date: Nov. 29, 2016

(87) PCT Pub. No.: WO2016/002280
PCT Pub. Date: Jan. 7, 2016

(65) Prior Publication Data

US 2017/0184351 A1 Jun. 29, 2017

(30) Foreign Application Priority Data

Jul. 4, 2014 (WO) ..... PCT/JP2014/067989

(51) Int. Cl.
*F28F 9/02* (2006.01)
*F25B 39/02* (2006.01)
*F25B 39/00* (2006.01)

(52) U.S. Cl.
CPC ..... *F28F 9/0275* (2013.01); *F25B 39/00* (2013.01); *F25B 39/028* (2013.01)

(58) Field of Classification Search
CPC ..... F16L 41/03; F25B 39/028
See application file for complete search history.

(56) References Cited

U.S. PATENT DOCUMENTS 2,027,057 A * 1/1936 Munters ..... F25B 17/02 62/101
3,864,938 A * 2/1975 Hayes, Jr. ..... F25B 41/06 137/14

(Continued)

FOREIGN PATENT DOCUMENTS

JP 54-150541 A 11/1979
JP 63-264293 A 11/1988

(Continued)

OTHER PUBLICATIONS

Office Action dated Jun. 6, 2017 issued in corresponding JP application No. 2016-531145 (and English translation).

(Continued)

*Primary Examiner* — Craig M Schneider
*Assistant Examiner* — Angelisa L. Hicks
(74) *Attorney, Agent, or Firm* — Posz Law Group, PLC

(57) ABSTRACT

A refrigerant distributor includes an inflow portion made of aluminum into which refrigerant flows through an inflow pipe, and a distributing portion made of aluminum that distributes incoming refrigerant to a plurality of outflow pipes. The distributing portion includes a main body portion connected to the inflow portion, and a plurality of outflow portions connected to the outflow pipes. The outflow portions are protruded from the main body portion, and are formed integrally with the main body portion.

20 Claims, 11 Drawing Sheets

(56) References Cited

U.S. PATENT DOCUMENTS

| | | | | | |
|---|---|---|---|---|---|
| 4,430,868 | A * | 2/1984 | Kern | F25B 39/028 62/504 |
| 4,829,944 | A | 5/1989 | Sukimoto et al. | |
| 4,887,557 | A | 12/1989 | Sukimoto et al. | |
| 5,341,656 | A * | 8/1994 | Rust, Jr. | F25B 41/06 62/324.6 |
| 7,392,664 | B2 * | 7/2008 | Wiser | F16B 37/00 285/386 |
| 2004/0052656 | A1 * | 3/2004 | Saito | F04F 5/04 417/313 |
| 2013/0313822 | A1 * | 11/2013 | Jones | B23K 1/0012 285/289.5 |

FOREIGN PATENT DOCUMENTS

| | | | | |
|---|---|---|---|---|
| JP | 63264293 | A | * 11/1988 | |
| JP | H04-148167 | A | 5/1992 | |
| JP | H08-159615 | A | 6/1996 | |
| JP | H08-226729 | A | 9/1996 | |
| JP | H11-316066 | A | 11/1999 | |
| JP | 2004-330266 | A | 11/2004 | |
| JP | 2005-114214 | A | 4/2005 | |
| JP | 2005-292035 | * | 4/2005 | |
| JP | 2006-112606 | A | 4/2006 | |
| JP | 2012013289 | A * | 1/2012 | |
| JP | 5328724 | B2 | 8/2013 | |
| JP | WO 2013118465 | A1 * | 8/2013 | F25B 41/00 |
| JP | 2013-234828 | A | 11/2013 | |
| JP | 2013-242088 | A | 12/2013 | |
| JP | 5713509 | B2 * | 5/2015 | B23P 11/00 |
| WO | 2010/119555 | A1 | 10/2010 | |

OTHER PUBLICATIONS

International Search Report of the International Searching Authority dated Jun. 2, 2015 for the corresponding international application No. PCT/JP2015/059983 (and English translation).

Office action dated Jul. 24, 2018 issued in corresponding JP patent application No. 2016-531145 (and English translation attached)

Office action dated Mar. 20, 2018 issued in corresponding JP patent application No. 2016-531145 (and English translation attached).

Office action dated Aug. 28, 2018 issued in corresponding CN patent application No. 201580035160.2 (and English translation attached).

* cited by examiner

REFRIGERANT DISTRIBUTOR, AND HEAT PUMP DEVICE HAVING THE REFRIGERANT DISTRIBUTOR

CROSS REFERENCE TO RELATED APPLICATIONS

This application is a U.S. national stage application of PCT/JP2015/059983 filed on Mar. 30, 2015, which claims priority to International Patent Application No. PCT/JP2014/067989 filed on Jul. 4, 2014, the contents of which are incorporated herein by reference.

TECHNICAL FIELD

The present invention relates to a refrigerant distributor, and a heat pump device having the refrigerant distributor.

BACKGROUND ART

In a heat exchanger functioning as a condenser or an evaporator of a refrigeration cycle apparatus such as an air-conditioning apparatus or a refrigeration apparatus, when a refrigerant flow passage therein is divided into a plurality of paths, a refrigerant distributor that distributes refrigerant to each path is necessary at the entrance of the heat exchanger.

For example, in a multi-type air-conditioning apparatus in which a plurality of outdoor units or indoor units are connected in parallel, a refrigerant distributor is necessary to distribute refrigerant from a main refrigerant flow passage to each unit.

Such a refrigerant distributor is desired to perform distribution to a plurality of paths more equally and with less unevenness from the viewpoint of further performance improvement of an air-conditioning apparatus. In recent years, aluminum has been increasingly used in air-conditioning parts from the viewpoint of product weight reduction and improvement in cost-performance ratio based on material workability.

When heat transfer tubes of a heat exchanger are copper pipes, a distributing portion of a refrigerant distributor is formed of copper or brass by shaving processing, and outflow pipes and an inflow pipe are formed of copper. The outflow pipes are brazed to the distributing portion, the inflow pipe is brazed to the distributing portion, and the outflow pipes are brazed to heat transfer tubes of the heat exchanger.

In a conventional refrigerant distributor 1, the heat capacity of outflow pipes 2 is small, and the heat capacity of a distributing portion 3 is large as shown in FIG. 8. Therefore, the heat capacity difference is large, and, when joining both members by burner brazing, temperature control is difficult, and brazability is not stable. To solve this problem of burner brazing, from the viewpoint of improvement in reproducibility of heat input, a high-frequency induction heating coil is commonly used as a brazing heating unit in the production site of a refrigerant distributor (especially made of copper or brass).

When the heat transfer tubes are made of aluminum, the distributing portion 3 of the refrigerant distributor 1 is formed of aluminum by shaving processing, and the distributing portion 3, the outflow pipes 2, and the inflow pipe 4 are also made of aluminum. The outflow pipes 2 are brazed to the distributing portion 3, and the inflow pipe 4 is brazed to the distributing portion 3.

On this occasion, in aluminum brazing, the melting point of brazing filler metal is about 580 degrees C., whereas the melting point of base material is about 650 degrees C., and the difference between the melting point of brazing filler metal and the melting point of base material, that is, the allowable temperature range is as small as about 70 degrees C., a fraction of that in copper brazing. Therefore, when performing joining by burner brazing, the heat capacity of the distributing portion 3 having a solid cylinder structure is large, temperature unevenness is likely to occur between the radially inner and outer parts, the allowable temperature range is partially exceeded, the base material melts, on the other hand a region where brazing filler metal is unmelted is formed, temperature control is difficult, and brazability is worsened. When a high-frequency induction heating coil is used, the reproducibility of heat input improves. However, because high-frequency current flows mainly at the surface of the work due to skin effect, heating is local, and, in the case of aluminum, base material is likely to melt.

That is, when joining a distributing portion 3 of an aluminum refrigerant distributor and outflow pipes 2, there is a problem in that, because the number of the outflow pipes 2 is large, the difference in melting point between brazing filler metal and base metal is small, and the heat capacity difference between the outflow pipes 2 and the distributing portion 3 is large, it is difficult to secure highly reliable brazing.

So, hitherto, in particular, the joining of outflow pipes 2 and a distributing portion 3 different in heat capacity has been performed by furnace brazing to eliminate cumbersomeness of temperature control (see, for example, Patent Literature 1).

Because a distributing portion 3 of a refrigerant distributor 1 is formed by shaving processing, in the case of aluminum, there is also a problem in that, because machinability is poor and machining takes time compared to copper or brass, processing cost is high.

CITATION LIST

Patent Literature

Patent Literature 1: Japanese Patent No. 5328724

SUMMARY OF INVENTION

Technical Problem

As described above, hitherto, the making of an aluminum refrigerant distributor has been achieved by furnace-brazing members different in heat capacity as described in Patent Literature 1. However, from the viewpoint of the size of the furnace, assembling workability, and the like, not all the members can be furnace-brazed. For example, an end of an outflow pipe that is too long to place in a furnace is partially burner-brazed as a separate member. Therefore, the number of member is large, the number of brazing places is also large, and the manufacturing process is cumbersome. There is a problem in that a furnace requires relatively large cost and space, and is therefore difficult to widely use for products.

There is a problem in that, when all the junctions are burner-brazed, temperature control is difficult and brazability is not stable when joining members that differ significantly in heat capacity, such as a distributing portion and outflow pipes. In particular, in the case of aluminum, when a distributing portion having a large heat capacity is heated with a burner or by high-frequency induction, temperature unevenness exceeding the allowable temperature is likely to occur, the allowable temperature range is partially exceeded, the base material melts, on the other hand a region where brazing filler metal is unmelted is formed, and temperature control is difficult.

In addition, because a distributing portion of a refrigerant distributor is formed by shaving processing, in the case of aluminum, there is also a problem in that, because machinability is poor and machining takes time compared to copper or brass, processing cost is high.

The present invention is made to solve the above-described problems, and it is an object of the present invention to obtain a refrigerant distributor in which the brazing between a distributing portion and a plurality of outflow pipes is good, that requires a small manufacturing man-hour, and that is excellent in productivity, and a heat pump device having the refrigerant distributor.

Solution to Problem

A refrigerant distributor according to an embodiment of the present invention includes an inflow portion into which refrigerant flows through an inflow pipe, and a distributing portion that distributes incoming refrigerant to a plurality of outflow pipes. The distributing portion includes a main body portion connected to the inflow portion, and a plurality of outflow portions connected to the outflow pipes. The outflow portions are protruded from the main body portion, and are formed integrally with the main body portion.

Advantageous Effects of Invention

According to the refrigerant distributor of the present invention, since the outflow portions of the distributing portion are protruded from the main body portion and are formed integrally with the main body portion, the heat capacity difference between the outflow pipes and the outflow portions is small, burner heat input can be given locally to the junctions, and therefore temperature control of burner heat input is facilitated. Therefore, the distributing portion and the outflow pipes can be satisfactorily brazed.

DETAILED DESCRIPTION

Embodiments of the present invention will now be described below with reference to the drawings. The present invention is not limited to the embodiments described below. In the following drawings, the relative size relationship of components may be different from the actual one.

Embodiment 1

First, the configuration of a fin and tube type heat exchanger 100 employing a refrigerant distributor 1 of Embodiment 1 will be described.

Figure 1:
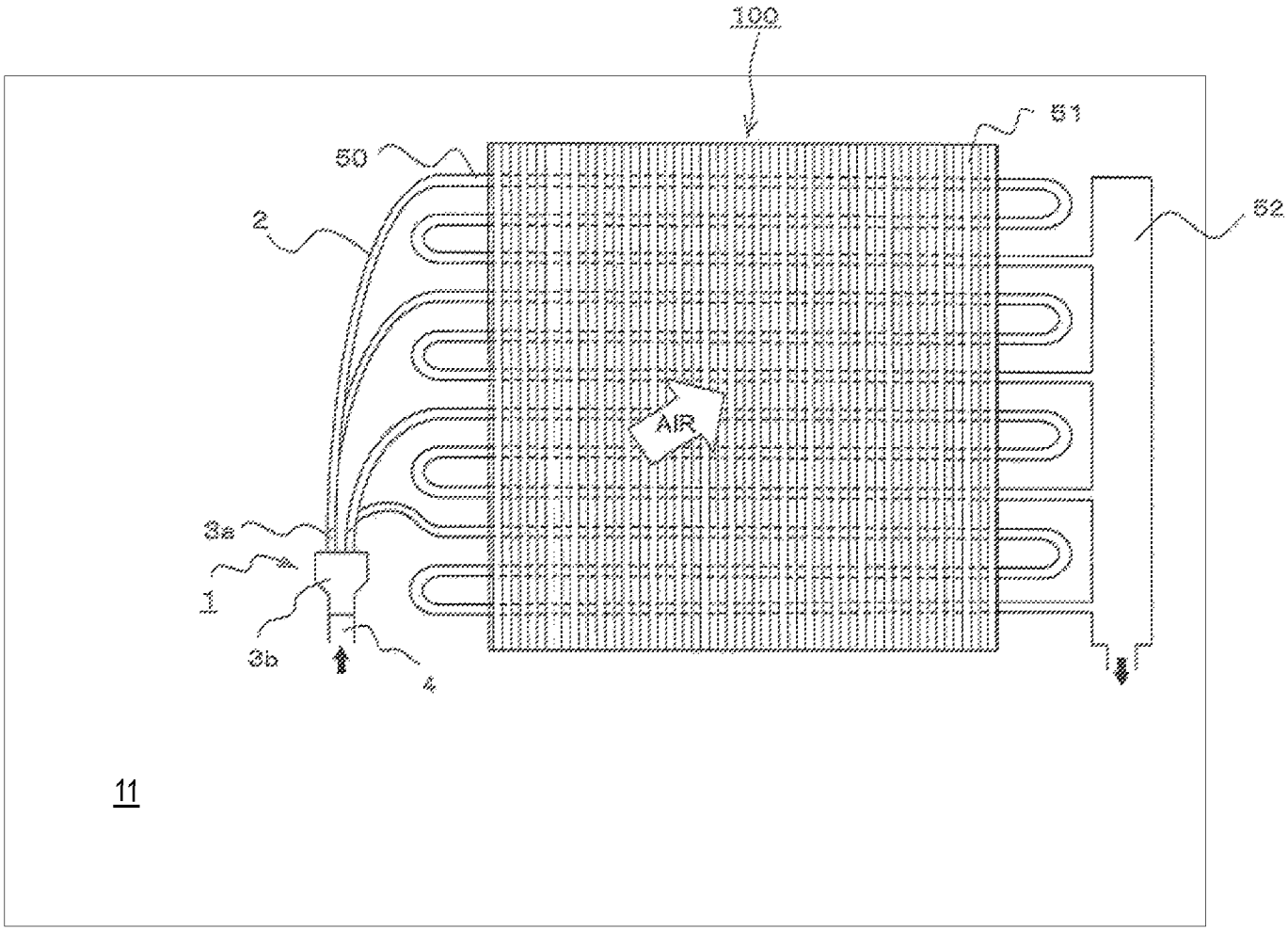
FIG. 1 shows the configuration of a heat exchanger employing a refrigerant distributor according to Embodiment 1.

FIG. 1 shows the configuration of a heat exchanger employing a refrigerant distributor according to Embodiment 1. A heat pump device 11 may comprise the refrigerant distributor 1.

For example, when the heat exchanger 100 functions as an evaporator, the refrigerant distributor 1 according to Embodiment 1 distributes two-phase refrigerant flowing into the fin and tube type heat exchanger 100 formed by heat transfer tubes 50 and fins 51, and the details will be described later. The two-phase refrigerant flowing through an inflow pipe 4 into the refrigerant distributor 1 branches to each outflow portion 3*a* in a main body portion 3*b* of a distributing portion 3, and flows through outflow pipes 2 into the heat transfer tubes 50 forming the paths of the heat exchanger 100.

The two-phase refrigerant flowing into the heat transfer tubes 50 of the heat exchanger 100 exchanges heat with air passing through the heat exchanger 100, through the fins 51 integrated with the heat transfer tubes 50, and evaporates to become gas refrigerant. The gas refrigerant converges in a gas header 52, and flows out toward the suction side of a compressor (not shown).

The heat transfer tubes 50 and the fins 51 are both formed of aluminum or aluminum alloy. The heat transfer tubes 50 may be circular pipes, flat pipes, or pipes having any other shape.

Next, the configuration of the refrigerant distributor 1 will be described.

Figure 2:
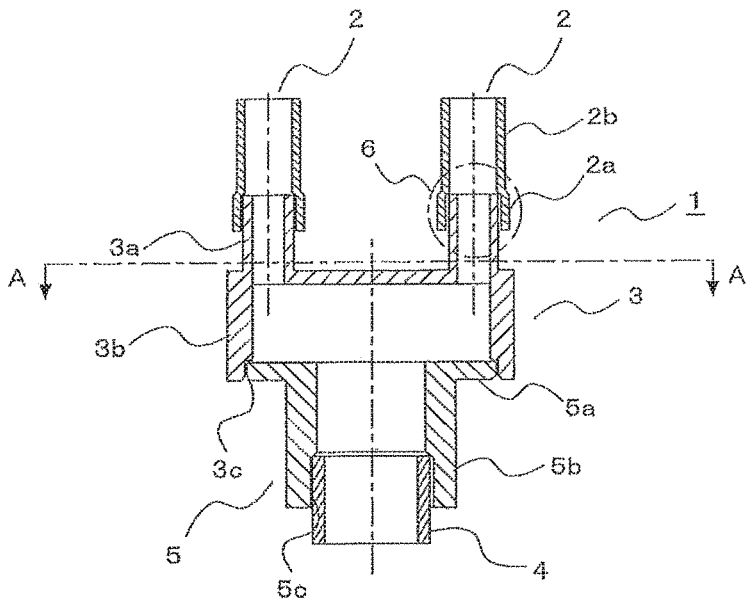
FIG. 2 is a vertical sectional view of the refrigerant distributor 1 according to Embodiment 1.

FIG. 2 is a vertical sectional view of the refrigerant distributor 1 according to Embodiment 1.

Figure 3:
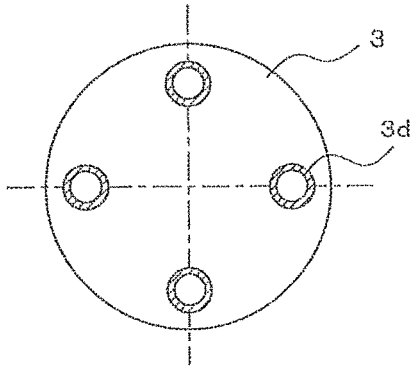
FIG. 3 is a sectional view taken along line A-A of the refrigerant distributor 1 according to Embodiment 1.

FIG. 3 is a sectional view taken along line A-A of the refrigerant distributor 1 according to Embodiment 1.

The refrigerant distributor 1 of Embodiment 1 is formed by an inflow portion 5 made of aluminum and a distributing portion 3 made of aluminum. The distributing portion 3 is formed by press working integrally with a plurality of outflow portions 3*a*, and has a cylindrical main body portion 3*b* and, for example, four cylindrical outflow portions 3*a*. In the upper surface of the main body portion 3*b* of the distributing portion 3, as shown in FIG. 2, outflow holes 3*d* communicating with the outflow pipes 2 open. The inflow portion 5 is formed by a circular disk portion 5*a* and a cylindrical portion 5*b* disposed coaxially with the central axis of the disk portion 5*a*.

The outflow pipes 2 are provided with expanded portions 2*a* in which the lower ends in FIG. 1 are expanded so as to be fitted on the outflow portions 3*a* from the outside, and that have a large bore compared to base portions 2*b*. Therefore, when fitting the outflow pipes 2 onto the outflow portions 3*a*, the expanded portions 2*a* are inserted into the outflow portions 3*a*, stepped portions between the base portions 2*b* and the expanded portions 2*a* of the outflow pipes 2 are abutted on the upper ends of the outflow portions 3*a*, and positioning is thereby performed.

The outside diameter and wall thickness of the base portions 2*b* of the outflow pipes 2 are preferably the same as the outside diameter and wall thickness of the outflow portions 3*a* of the distributing portion 3.

When joining the distributing portion 3 and the inflow portion 5, the outer periphery of the disk portion 5*a* of the inflow portion 5 is fitted into a circular cutout portion 3*c* formed in a circumferential surface at the lower end of the main body portion 3*b*. When joining the inflow pipe 4 and the inflow portion 5, the outer peripheral surface of the cylindrical inflow pipe 4 is fitted into a circular cutout portion 5*c* formed in the inner peripheral surface of the lower end of the cylindrical portion 5*b* of the inflow portion 5.

After that, the distributing portion 3 and the inflow portion 5 are joined by burner brazing, then the inflow pipe 4 and the inflow portion 5 are joined by burner brazing, and the outflow pipes 2 and the outflow portions 3*a* are joined by burner brazing.

A burner brazing method is a joining method in which, as with the Nocolok brazing method, which is furnace brazing, after applying fluoride flux to a junction and placing brazing filler metal on the junction, the brazing filler metal is heated with a burner to the melting point 590 degrees C., and the brazing filler metal is melted to perform joining. A gas burner uses gas such as city gas, propane, or mixed gas of acetylene and oxygen.

Burner brazing is performed in the atmosphere, and a junction is directly heated with a burner, and therefore temperature control is difficult. In particular, in the case of brazing aluminum members, because aluminum does not undergo a change in color near the melting point, and the difference in melting point between brazing filler metal and base material is small, the brazability is poor. If brazing is not successful, and joining is incomplete, refrigerant flowing therethrough leaks to the outside air.

However, since the refrigerant distributor 1 according to Embodiment 1 is configured such that the outside diameter and wall thickness of the base portions 2*b* of the outflow pipes 2 are the same as the outside diameter and wall thickness of the outflow portions 3*a* of the distributing portion 3, the heat capacity difference between the outflow portions 3*a* and the outflow pipes 2 in junctions 6 can be reduced, and in addition, burner heat input can be given locally also to the junctions 6, and therefore temperature control of burner heat input is facilitated, and the distributing portion 3 and the outflow pipes 2 can be satisfactorily brazed.

Since the distributing portion 3 and the inflow portion 5 are formed by press working, shaving processing is eliminated, working man-hour can be reduced, and productivity can be improved.

Since the heat capacity of the outflow portions 3*a* provided in the upper part of the distributing portion 3 is small, burner brazing time per junction 6 can be reduced, and productivity can be improved.

Figure 8:
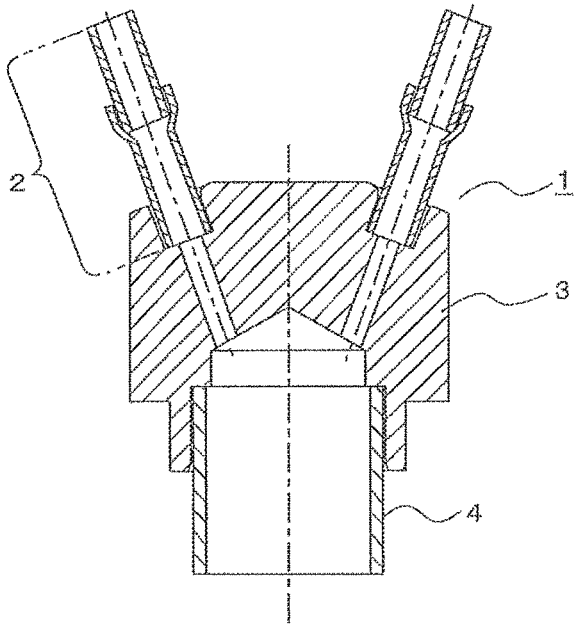
FIG. 8 is a vertical sectional view of a conventional refrigerant distributor.

Since the outflow portions 3*a* are provided in the upper part of the distributing portion 3 and are integrally formed by press working, the number of brazing points of the outflow pipes 2, which is two per flow passage in the conventional refrigerant distributor shown in FIG. 8, can be reduced to one, and productivity can be improved.

Figure 4:
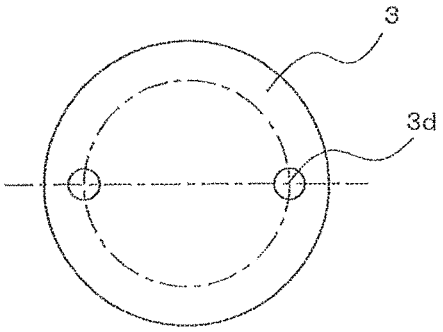
FIG. 4 is a sectional view taken along line A-A of another example 1 of the refrigerant distributor 1 according to Embodiment 1.
Figure 5:
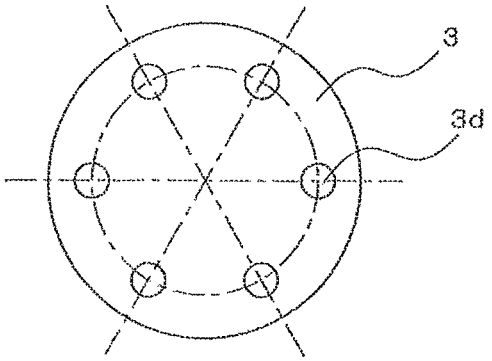
FIG. 5 is a sectional view taken along line A-A of another example 2 of the refrigerant distributor 1 according to Embodiment 1.
Figure 6:
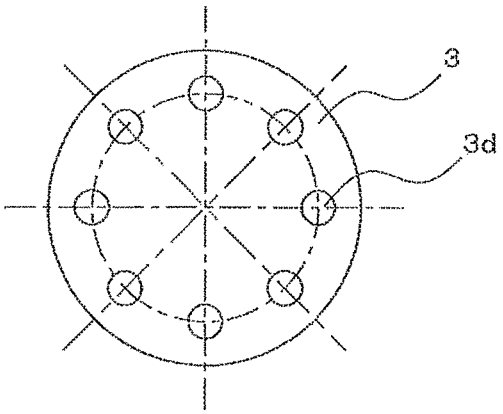
FIG. 6 is a sectional view taken along line A-A of another example 3 of the refrigerant distributor 1 according to Embodiment 1.

FIGS. 4 to 6 show modifications of the distributing portion 3 of the refrigerant distributor 1 according to Embodiment 1.

FIG. 4 is a sectional view taken along line A-A of another example 1 of the refrigerant distributor 1 according to Embodiment 1.

FIG. 5 is a sectional view taken along line A-A of another example 2 of the refrigerant distributor 1 according to Embodiment 1.

FIG. 6 is a sectional view taken along line A-A of another example 3 of the refrigerant distributor 1 according to Embodiment 1.

Although, in FIGS. 4 to 6, examples in which the number of outflow holes 3*d* of the distributing portion 3 is two, six, and eight are shown, the distributing portion 3 may have any number of outflow holes 3*d*.

Embodiment 2

A refrigerant distributor 1 according to Embodiment 2 is the same as the refrigerant distributor according to Embodiment 1 except for the configuration of junctions between the inflow pipe 4 and the inflow portion 5, between the distributing portion 3 and the inflow portion 5, and between the outflow pipes 2 and the outflow portions 3*a*. So, the difference from the refrigerant distributor 1 according to Embodiment 1 will be mainly described.

Figure 7:
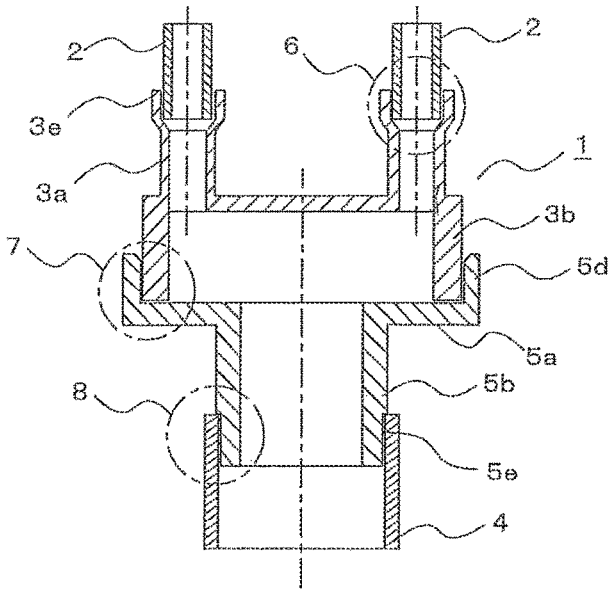
FIG. 7 is a vertical sectional view of the refrigerant distributor 1 according to Embodiment 2.

FIG. 7 is a vertical sectional view of the refrigerant distributor 1 according to Embodiment 2.

The outflow portions 3*a* are provided with expanded portions 3*e* in which the upper ends in FIG. 7 are expanded so as to be fitted on the outflow pipes 2 from the outside, and that have a large bore compared to the outflow portions 3*a*. Therefore, when fitting the outflow pipes 2 into the expanded portions 3*e*, the outflow pipes 2 are inserted into the expanded portions 3*e*, the lower ends of the outflow pipes 2 are abutted on stepped portions between the outflow portions 3*a* and the expanded portions 3*e*, and positioning is thereby performed.

The outside diameter and wall thickness of the outflow pipes 2 are preferably the same as the outside diameter and wall thickness of the outflow portions 3*a* of the distributing portion 3.

When joining the distributing portion 3 and the inflow portion 5, the lower end of the main body portion 3*b* is fitted on the inner peripheral surface of the cylindrical rib 5*d* erected on the outer periphery of the disk portion 5*a* of the inflow portion 5. When joining the inflow pipe 4 and the inflow portion 5, the inner peripheral surface of the cylindrical inflow pipe 4 is fitted into a cutout portion 5*e* formed in the outer peripheral surface of the lower end of the cylindrical portion 5*b* of the inflow portion 5.

After that, the distributing portion 3 and the inflow portion 5 are joined by burner brazing, then the inflow pipe 4 and the inflow portion 5 are joined by burner brazing, and the outflow pipes 2 and the outflow portions 3*a* are joined by burner brazing.

In the refrigerant distributor 1 according to Embodiment 2, the junction 6 between the outflow pipes 2 and the outflow portions 3*a*, the junction 7 between the distributing portion 3 and the inflow portion 5, and the junction 8 between the inflow pipe 4 and the inflow portion 5 are all joined in such a manner that the lower member is on the outer side and receives the upper member, and therefore the outflow pipes 2, the distributing portion 3, the inflow pipe 4, and the inflow portion 5 can be joined by brazing at the same time without changing brazing posture. Therefore, the brazing man-hour can be reduced, and productivity can be improved.

Since brazing can be performed at the same time without changing brazing posture, not only burner brazing but also automatic brazing and furnace brazing can be used, unevenness in heat input due to a working method can be suppressed, and the brazing temperature control can be facilitated.

The brazing process of the refrigerant distributor 1 according to Embodiment 2 in which work is performed at the same time can also be used in a state in which the refrigerant distributor 1 according to Embodiment 1 is upside down.

Since, as in Embodiment 1, the outside diameter and wall thickness of the outflow pipes 2 are the same as the outside diameter and wall thickness of the outflow portions 3*a* of the distributing portion 3, the heat capacity difference between the outflow portions 3*a* and the outflow pipes 2 in junctions 6 can be reduced, and in addition, burner heat input can be given locally also to the junctions 6, and therefore temperature control of burner heat input is facilitated, and the distributing portion 3 and the outflow pipes 2 can be satisfactorily brazed.

Since the distributing portion 3 and the inflow portion 5 are formed by press working, shaving processing is eliminated, working man-hour can be reduced, and productivity can be improved.

Since the heat capacity of the outflow portions 3*a* provided in the upper part of the distributing portion 3 is small, burner brazing time per junction 6 can be reduced, and productivity can be improved.

Since the outflow portions 3*a* are provided in the upper part of the distributing portion 3 and are integrally formed by press working, the number of brazing points of the outflow pipes 2, which is two per flow passage in the conventional refrigerant distributor shown in FIG. 8, can be reduced to one, and productivity can be improved.

Embodiment 3

A refrigerant distributor 1 according to Embodiment 3 is substantially the same as the refrigerant distributor according to Embodiment 1 except for the configuration of junctions between the outflow pipes 2 and the outflow portions 3*a*. So, the difference from the refrigerant distributor 1 according to Embodiment 1 will be mainly described.

Figure 9:
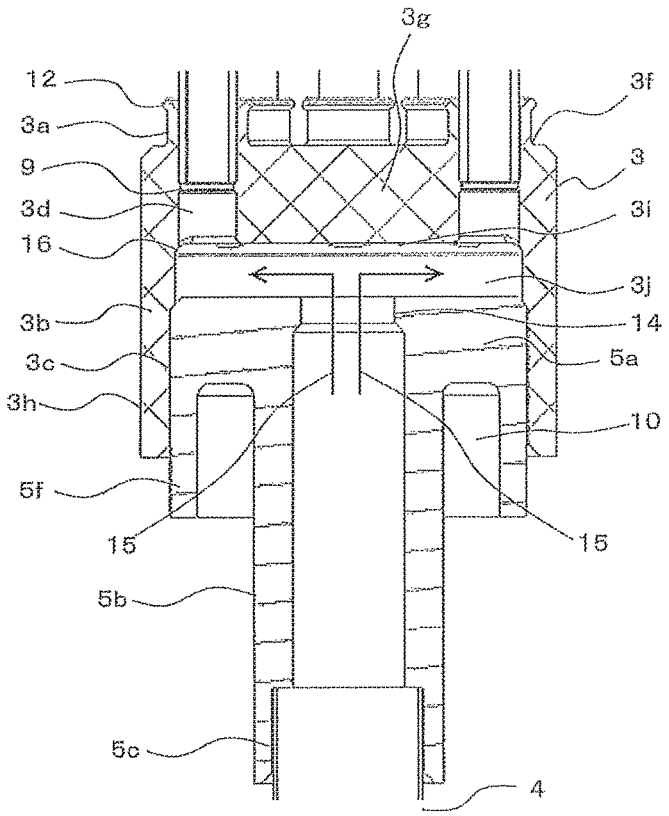
FIG. 9 is a vertical sectional view of the refrigerant distributor 1 according to Embodiment 3.

FIG. 9 is a vertical sectional view of the refrigerant distributor 1 according to Embodiment 3.

Figure 10:
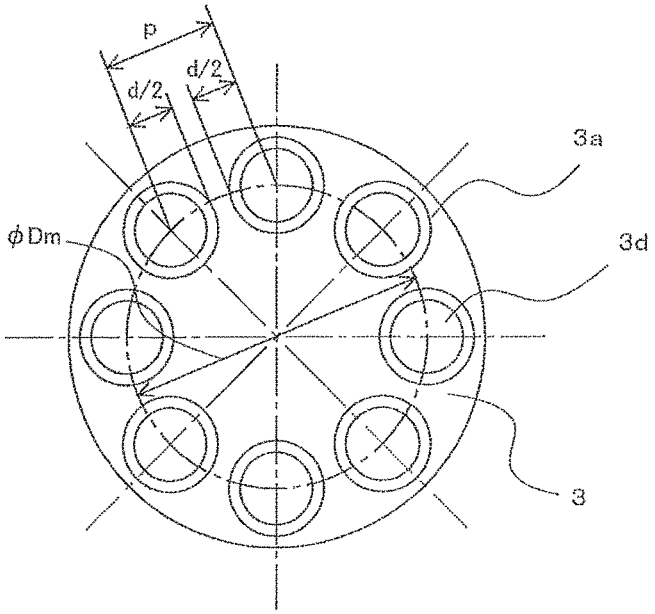
FIG. 10 is a plan view showing the relative size relationship of a distributing portion 3 according to Embodiment 3.

FIG. 10 is a plan view showing the relative size relationship of a distributing portion 3 according to Embodiment 3.

Figure 11:
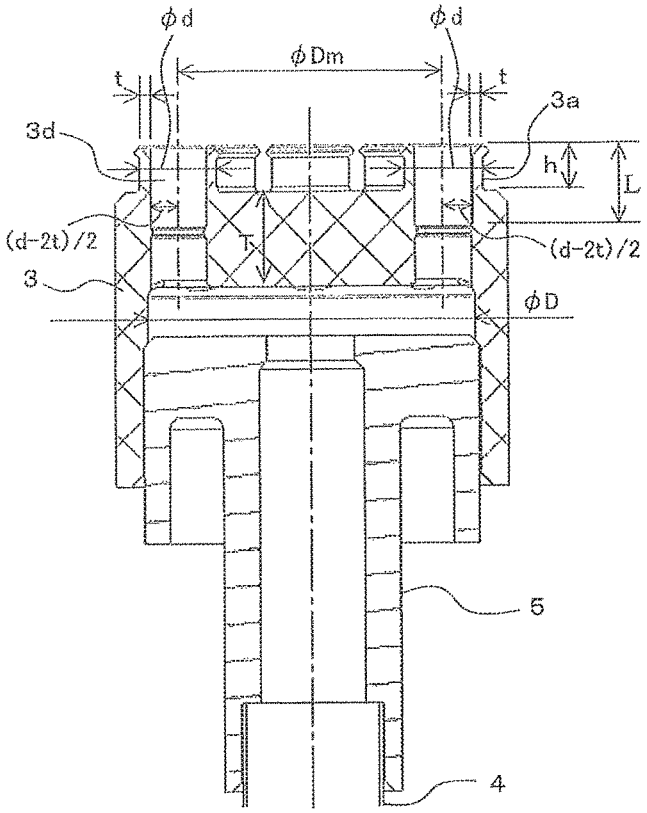
FIG. 11 is a vertical sectional view showing the relative size relationship of the distributing portion 3 according to Embodiment 3.

FIG. 11 is a vertical sectional view showing the relative size relationship of the distributing portion 3 according to Embodiment 3.

A main body portion 3*b* of the distributing portion 3 is formed by cold forging press-like drawing (forging drawing) of a thick plate. The main body portion 3*b* is formed by a top plate portion 3*g* and a cylindrical body portion 3*h* having a cylindrical space 3*j* therein. A corner portion 16 having a rounded shape for stress relaxation is provided in the corner part where the lower surface portion 3*i* of the top plate portion 3*g* and the body portion 3*h* meet.

An inflow portion 5 has an outer peripheral cylindrical portion 5*f* provided on the outer peripheral side of a disk portion 5*a*, and a cylindrical portion 5*b* to which an inflow pipe 4 is connected. An annular cutout portion 10 is formed between the outer peripheral cylindrical portion 5*f* and the cylindrical portion 5*b*. The cutout portion 10 is formed for suppressing temperature unevenness during the brazing of the inflow portion 5 to the distributing portion 3, and for reducing the heat capacity. Several (three or four) center alignment protrusions for uniformly setting the brazing clearance between the body portion 3*h* and the outer peripheral cylindrical portion 5*f* are provided on the inner peripheral side of the body portion 3*h* at regular intervals as part of the press working (not shown), so that reliable aluminum brazing is facilitated.

The top plate thickness of the top plate portion 3*g* required to secure pressure resisting strength is expressed, using the relational expression of bending stress of a disk in material mechanics, as:

$$T \geq D\sqrt{(0.19P/\sigma)} \quad \text{(Expression 1)},$$

where T [mm] is the thickness of the top plate portion 3*g* shown in FIG. 10 and FIG. 11, D [mm] is the inside diameter of the body portion 3*h*, P [Mpa] is design pressure, and σ [N/mm2] is allowable tensile stress of material. When the specification of a subject refrigerant distributor 1 is such that P=4.15 [Mpa] and σ=8 [Mpa] (tensile stress of aluminum thick plate A1070 corrected to a temperature of 125 degrees C.), $$T \geq 0.31D.$$

As for the relative size relationship of the inside diameter D, $$Dm\pi \geq p \times N > d \times N \quad \text{(Expression 2)},$$

and $$D = Dm + (d - 2t) \quad \text{(Expression 3)},$$

where d [mm] is the outside diameter of the outflow portions 3*a*, *t* [mm] is the wall thickness of the outflow portions 3*a*, *p* [mm] is the distance between pitches of adjacent outflow portions 3*a*, N is the number of distribution of the distributing portion 3, and Dm [mm] is the pitch circle diameter of the group of outflow portions 3*a*. From Expression 2 and Expression 3, there is a relationship:

$$D \geq d \times N/\pi + (d - 2t) \quad \text{(Expression 4)}.$$

If values of the outside diameter d=ϕ 7 mm and the wall thickness t=1 mm are used as a pipe wall thickness example complying with High Pressure Gas Safety Act and Refrigeration Safety Regulations, from Expression 4, $$D \geq 2.23N + 5.$$

If Expression 4 is substituted in Expression 1, there is a relationship:

$$T \geq 0.69N + 1.55 \quad \text{(Expression 5)}.$$

When the number of distribution in this example N=8, substituting this in Expression 5 yields:

$$T \geq 7 \text{ [mm]}.$$

To secure required strength against the design pressure, the thickness T of the top plate portion 3*g* is 7 mm (7 times the wall thickness of the outflow portions 3*a*) or more. If this is applied to the number of distribution of applications in general N≥3, the thickness T of the top plate portion 3*g* is required to be three or more times larger than the wall thickness of the outflow portions 3*a*.

The wall thickness of the outflow portions 3*a* is set so as to be 1 to 2 times the wall thickness of the outflow pipes 2 (for example, the outflow portions 3*a* have an outside diameter of ϕ 7 mm and a wall thickness of 1 mm, and the outflow pipes 2 have an outside diameter of ϕ 5 mm and a wall thickness of 0.7 mm). Base portions 3*f* of the outflow portions 3*a* are formed as part of the press working in a rounded shape for the purpose of stress relaxation when excessive external force is applied during the manufacturing process or the like.

Outflow pipes 2 are fitted on and brazed to the inside diameter sides of the outflow portions 3*a*. On this occasion, the lower ends of the outflow pipes 2 abut on pipe stopper portions 9 disposed in the outflow holes 3*d* and are thereby positioned. The pipe stopper portions 9 are stepped portions that are provided, as part of press working of the outflow portions 3*a*, so as to have an inside diameter slightly smaller than the inside diameter of the outflow holes 3*d*. These stepped portions only have to be, for example, about 0.3 mm in the radial direction. As long as a constraint condition that these stepped portions have an inside diameter larger than the inside diameter of the outflow pipes 2 so that these stepped portions themselves do not cause pressure loss and a processing constraint condition that each part can be formed by press working without problems are satisfied, the inside diameter of the outflow holes 3*d* may slightly differ between both sides of the pipe stopper portions 9 (although not shown, only the outflow portion 3*a* side parts may have an inside diameter larger than that of the pipe stopper portions 9).

The depth L from the upper ends of the outflow portions 3*a* to the pipe stopper portions 9 in the axial direction of the outflow holes 3*d* is set, as a fitting depth required for a brazed joint (the brazing length in the axial direction of the outflow portions 3*a* and the outflow pipes 2), such that L≥6 mm when the outside diameter of the outflow pipes 2 is ϕ 7 mm. The axial length (height h) of the outflow portions 3*a* is preferably equal to or greater than half of the brazing depth L to exert the effect of Embodiment 3, and is therefore set such that, for example, h=4 mm in this example.

As can be seen from this example, in the refrigerant distributor 1, for pressure resistance, the wall thickness ratio T/t of the thickness T of the top plate portion 3*g* (=7 mm or more) to the wall thickness t of the outflow portions 3*a* (=1 mm) is as high as 7 in the above example, and 3 or more in applications in general in which N=3 or more. Therefore, the outflow portions 3*a* of the present invention cannot be formed by simple drawing or burring, which is the same wall thickness level of thin plate processing like a conventional art (see Japanese Patent No. 2776626 and Japanese Patent No. 3396770) (according to a conventional art literature "Design of Progressive Press Die" (Nikkan Kogyo Shimbun, Ltd.), in burring, because of the constraint of plate thickness reduction, in the case of aluminum, T/t is specified to be ≤1/√0.29=1.9 at its maximum).

In Embodiment 3, the ratio h/dm of the outflow portion length L (=4 mm or more) to the wall thickness center diameter ϕ dm (=d−t=6 mm) of N outflow portions 3*a* is as relatively high as 0.67 or more. Therefore, in simple drawing, there is such a constraint that because it is necessary to reduce the disk area of a given region extending throughout the circumference of the outer edge, it is difficult to form a plurality of outflow portions. Therefore, in burring, only the volume of circular rings on the inside diameter side before processing can be allotted to the volume of the cylindrical portions of the outflow portions 3*a* after processing, there is a limit on the height, and achievement is difficult (according to the above literature, h/dm≤0.25 or less).

So, to form thin and high outflow portions 3*a* despite such a large wall thickness difference, it is necessary to press a given region of a thick plate using a cold forging-like press working to partially reduce the plate thickness. By securing material of a volume required for the erection of the outflow portion 3*a* and undergoing a plurality of processes using appropriate combination of punch and die, the material is moved and shaped, and outflow portions 3*a* having a desired height are formed.

Since Embodiment 3 uses cold forging-like press working based on such a volume invariance principle, thin and high outflow portions 3*a* can be formed from a thick plate. The region where the plate thickness is reduced is finally directly below the outflow portions 3*a*. However, in the process of forming the outflow portions 3*a*, the present invention is not limited to this, and the necessary region may be pressed, and material may be moved in and out in a plurality of processes.

Before joining the distributing portion 3 made of aluminum thus formed by press working to the outflow pipes 2, in advance, the distributing portion 3 and the inflow portion 5, and the inflow pipe 4 and the inflow portion 5 are joined separately or at the same time by burner brazing or furnace brazing.

Figure 12:
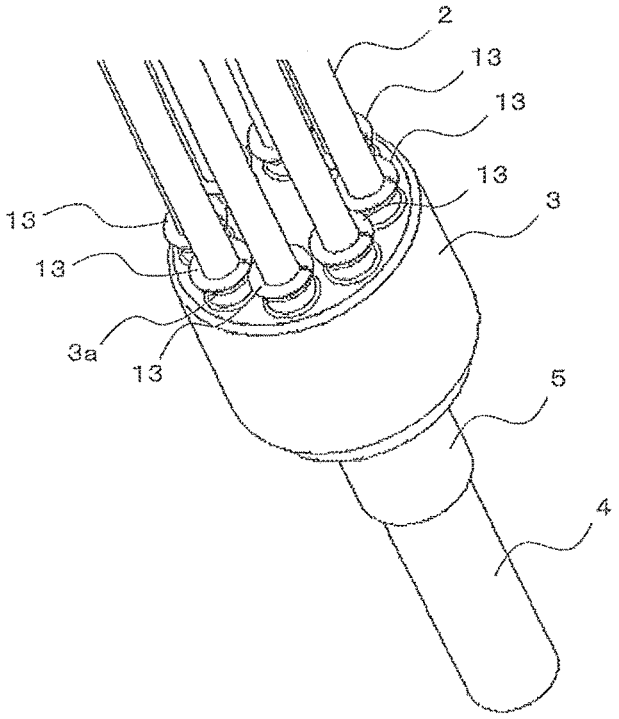
FIG. 12 is a perspective view showing the state before brazing of the refrigerant distributor 1 according to Embodiment 3 and outflow pipes 2.

FIG. 12 is a perspective view showing the state before brazing of the refrigerant distributor 1 according to Embodiment 3 and outflow pipes 2.

Figure 13:
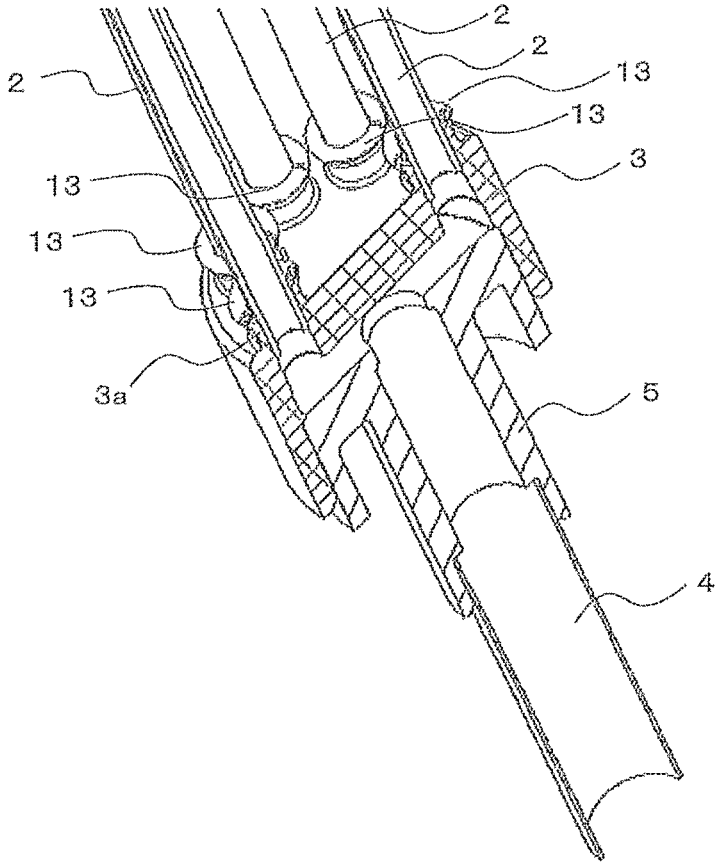
FIG. 13 is a sectional perspective view showing the state before brazing of the refrigerant distributor 1 according to Embodiment 3 and outflow pipes 2.

FIG. 13 is a sectional perspective view showing the state before brazing of the refrigerant distributor 1 according to Embodiment 3 and outflow pipes 2.

At the upper ends of the outflow portions 3*a*, brazing filler metal rings A13 are disposed in advance, and flare portions 12 that expand to the outside of the outflow portions 3*a* are provided as part of press working of the outflow portions 3*a* so that brazing filler metal easily flow into the clearance between themselves and the outflow pipes 2. The outside diameter of the flare portions 12 is larger than the outside diameter of the outflow portions 3*a* so that the brazing filler metal rings A13 are less likely to overflow.

In this state, a plurality of burners are disposed on the outer periphery of the main body portion 3*b* of the distributing portion 3, and are stationary or revolved (the work is rotated or the burners are revolved), and the outer peripheral side of the main body portion 3*b* is heated. Because the main body portion 3*b* has a heat capacity corresponding to the thickness of the top plate portion 3*g* required for withstanding pressure, in and out temperature glide in the radial direction and temperature unevenness in the circumferential direction are likely to occur. On the other hand, since the outflow portions 3*a* have a thin wall thickness and a small heat capacity, and are disposed on the outer peripheral side of the main body portion 3*b*, burner heat input accumulated mainly on the outer peripheral side of the main body portion 3*b* spreads throughout the circumference of the outflow portions 3*a* by heat transfer, and the outflow portions 3*a* are easily temperature-equalized. A phenomenon in which the outflow portions 3*a* have less temperature unevenness and are easily temperature-equalized owing to heat transfer compared to the main body portion 3*b* can be confirmed by a heat transfer analysis simulation and infrared thermography measurement.

When heat is transferred from the thus temperature-equalized and heated outflow portions 3*a* to the brazing filler metal rings A13 and the outflow pipes 2, the brazing filler metal rings A13 melt, and the main body portion 3*b* and the outflow pipes 2 are brazed. On this occasion, since the outflow portions 3*a* have a small heat capacity and are temperature-equalized compared to the distributing portion 3, highly reliable brazing free from partial melting of base material, incomplete melting, short supply of brazing filler metal, and the like is performed.

The flow of refrigerant in the thus assembled and joined refrigerant distributor 1 will be described. A throttle portion 14 in which the cross-sectional area of a refrigerant flow passage is reduced is provided at the upper end of the inflow portion 5 so that the flow velocity of refrigerant flowing from the inflow pipe 4 can be made appropriate. Refrigerant passing through the throttle portion 14 collides with a lower surface portion 3*i* of the top plate portion 3*g*. The lower surface portion 3*i* has a planar shape unlike a conical surface in a conventional refrigerant distributor. Therefore, even if refrigerant is an uneven flow such that the density of flow from the throttle portion 14 is not axially symmetric, the refrigerant is likely to spread radially outward and substantially evenly after colliding with the lower surface portion 3*i*.

The outflow holes 3*d* are disposed such that their inner peripheries are substantially in contact with the inner periphery of the cylindrical space 3*j*. Therefore, the refrigerant flow 15 radially spread along the lower surface portion 3*i* easily flows into the outflow holes 3*d* without scattering even when it collides with the outer wall of the cylindrical space 3*j* at the termination in the radial direction, and efficient and substantially even distribution and outflow of refrigerant are performed.

Embodiment 4

In a refrigerant distributor 1 according to Embodiment 4, the basic configurations of junctions between the inflow pipe 4 and the inflow portion 5, the distributing portion 3 and the inflow portion 5, and the outflow pipes 2 and the outflow portions 3*a* are the same as those in the refrigerant distributor 1 according to Embodiment 3. So, the difference from the refrigerant distributor 1 according to Embodiment 3 will be mainly described.

Since aluminum is a corrosion-prone metal, an anticorrosion design according to the use environment or the like is generally applied to aluminum pipe parts. Material makers are providing, as an anticorrosion material for circular pipes themselves, anticorrosion layer clad pipes that are made by extruding sacrifice anticorrosion material on the outer surface side at the same time when extruding pipe material, and zinc spraying pipes that are made by spraying zinc after extrusion, and, as an anticorrosion material for plate material, anticorrosion layer clad plates the anticorrosion layers of which are integrally formed by rolling sacrifice anticorrosion material at the same time. Of such materials, plate materials having a relatively small thickness, for which there is a wide need, are brought to the market, whereas thick materials, for which there is little need and mass production effect cannot be expected, are hardly commercialized. Commonly used measures for anticorrosion of thick parts include retarding the progress of corrosion by increasing the plate thickness or disposing sacrifice anticorrosion material such as zinc in the vicinity or on the surface of the object part.

The distributing portion 3 made of aluminum in Embodiment 4 is formed from a thick plate by cold forging-like drawing (or machining) and press working as described above. The main body portion 3*b* remains as a thick plate having a plate thickness of 3 mm or more, and therefore keeping the thickness can be a measure for anticorrosion. However, as for the thin outflow portions 3*a*, a measure such as disposing zinc-containing material in the vicinity is added.

Figure 14:
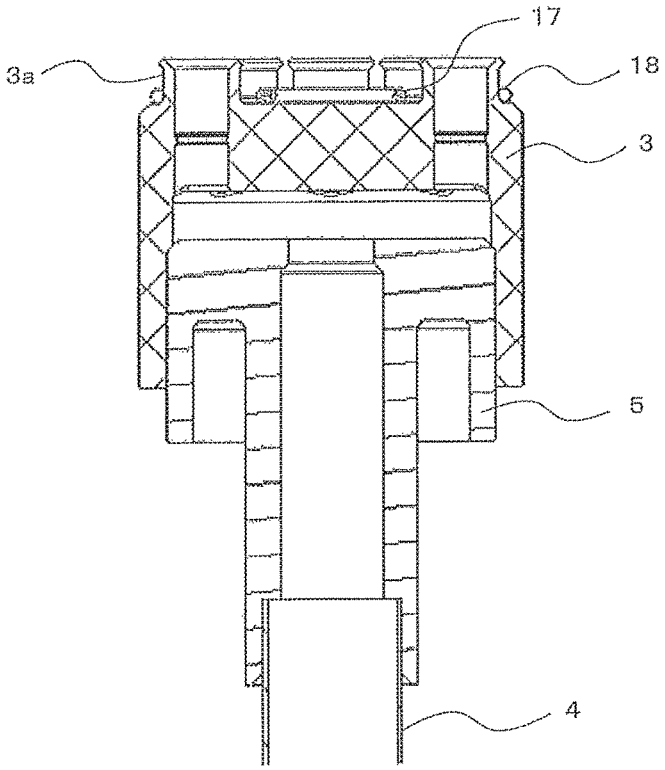
FIG. 14 is a vertical sectional view showing the state before brazing in which a brazing filler metal ring B17 and a brazing filler metal ring C18 are disposed on the base portions 3*f* of the distributing portion 3 according to Embodiment 4.

FIG. 14 is a vertical sectional view showing the state before brazing in which a brazing filler metal ring B17 and a brazing filler metal ring C18 are disposed on the base portions 3*f* of the distributing portion 3 according to Embodiment 4.

Figure 15:
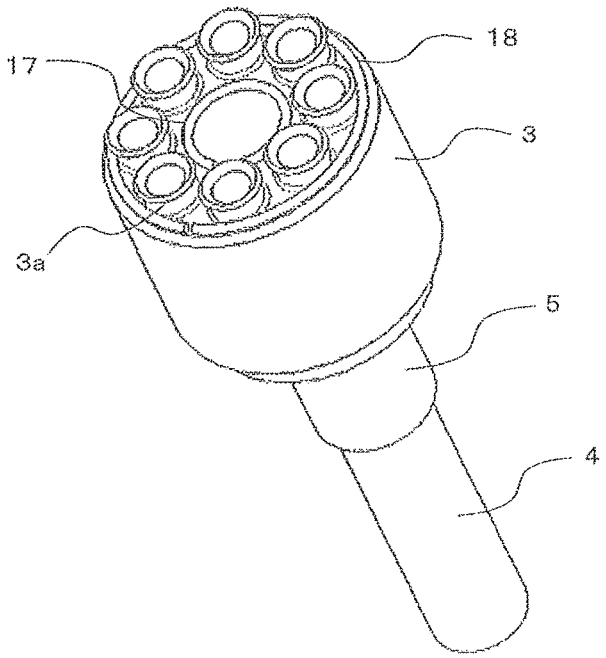
FIG. 15 is a perspective view showing the state before brazing in which a brazing filler metal ring B17 and a brazing filler metal ring C18 are disposed on the base portions 3*f* of the distributing portion 3 according to Embodiment 4.

FIG. 15 is a perspective view showing the state before brazing in which a brazing filler metal ring B17 and a brazing filler metal ring C18 are disposed on the base portions 3*f* of the distributing portion 3 according to Embodiment 4.

Figure 16:
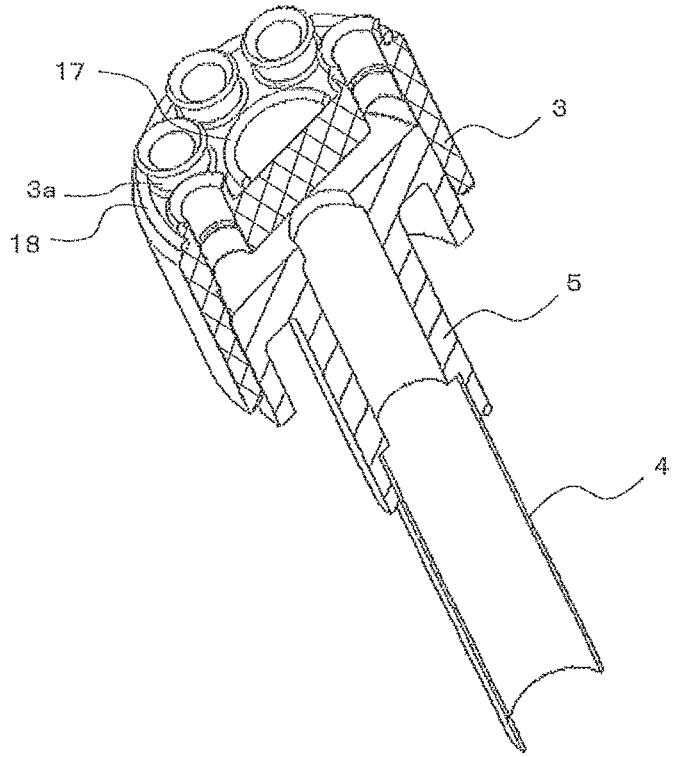
FIG. 16 is a perspective sectional view showing the state before brazing in which a brazing filler metal ring B17 and a brazing filler metal ring C18 are disposed on the base portions 3*f* of the distributing portion 3 according to Embodiment 4.

FIG. 16 is a perspective sectional view showing the state before brazing in which a brazing filler metal ring B17 and a brazing filler metal ring C18 are disposed on the base portions 3*f* of the distributing portion 3 according to Embodiment 4.

Figure 17:
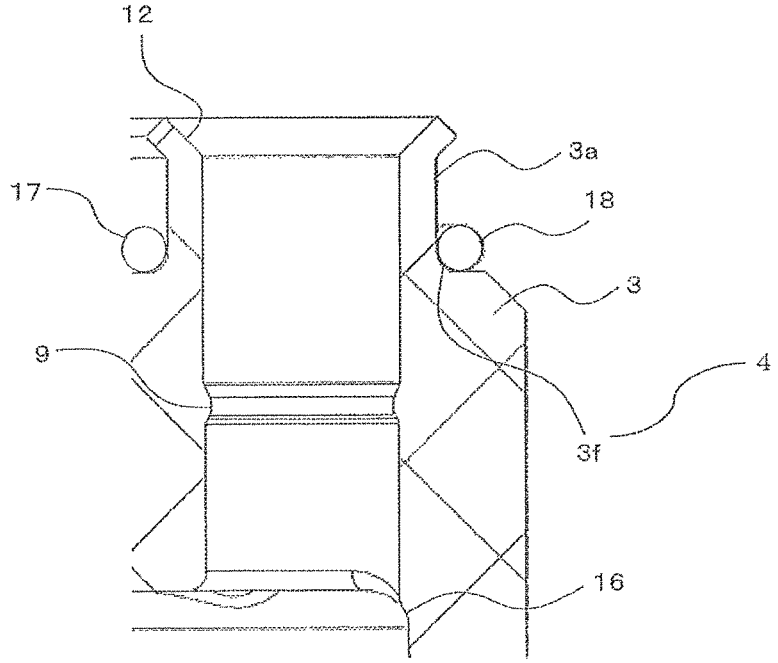
FIG. 17 is a detailed sectional view showing the state before brazing in which a brazing filler metal ring B17 and a brazing filler metal ring C18 are disposed on the base portions 3*f* of the distributing portion 3 according to Embodiment 4.

FIG. 17 is a detailed sectional view showing the state before brazing in which a brazing filler metal ring B17 and a brazing filler metal ring C18 are disposed on the base portions 3*f* of the distributing portion 3 according to Embodiment 4.

As shown in FIGS. 14 to 17, on the top surface of the distributing portion 3, for the base portions 3*f* of N outflow portions 3*a*, there are disposed an inner peripheral brazing filler metal ring B17 formed so as to have a diameter equal to or smaller than the diameter of the inscribed circle, and an outer peripheral brazing filler metal ring C18 formed so as to have a diameter equal to or larger than the diameter of the circumscribed circle. That is, it has an outer peripheral brazing filler metal ring C18 disposed on the outer side of the circumscribed circle of the plurality of outflow portions 3*a*, and an inner peripheral brazing filler metal ring B17 disposed on the inner side of the inscribed circle of the plurality of outflow portions 3*a*. The outer peripheral brazing filler metal ring C18 contains more zinc (Zn) compared to aluminum-based brazing filler metal for aluminum brazing.

When the distributing portion 3 is heated during the burner brazing of the outflow pipes 2 and the outflow portions 3*a*, at the same time as the ordinary brazing filler metal rings A13 according to Embodiment 4, the heat input transfers to the inner peripheral brazing filler metal ring B17 and the outer peripheral brazing filler metal ring C18 disposed on the base portions 3*f*, and these brazing filler metal rings are melted, melted zinc (Zn) is thereby spread and disposed around the base portions 3*f* of the outflow portions 3*a* and on the upper surface of the top plate portion 3*g*, and the sacrifice anticorrosion effect satisfying the corrosion life can be obtained.

According to Embodiment 4, a measure against corrosion of the distributing portion 3 consisting of the thick main body portion 3*b* and the thin outflow portions 3*a* in Embodiment 4 can be easily achieved, without separately requiring a special anticorrosion treatment process such as zinc spraying or zinc coating, just by supplying brazing filler metal rings containing zinc at the same time as ordinary brazing filler metal rings and performing ordinary brazing heating such as burner.

In Embodiment 4, an example is shown in which, for the base portions 3*f* of the outflow portions 3*a*, an inner peripheral brazing filler metal ring B17 having a diameter equal to or smaller than the diameter of the inscribed circle, and an outer peripheral brazing filler metal ring C18 having a diameter equal to or larger than the diameter of the circumscribed circle are disposed on the base portions 3*f*. A similar effect can be obtained by disposing N rings of zinc-containing brazing filler metal (not shown) slightly larger than the outside diameter of the outflow portions 3*a* on the base portions 3*f*. The zinc content and the distance from the inscribed circle and the circumscribed circle of the base portions 3*f* of the outflow portions 3*a* may be determined in advance according to corrosion environment conditions. Not only brazing filler metal but also, for example, zinc hoop material itself seems to be able to be used as the above zinc-containing material. However, in fact, it is prone to erosion, and attention is required. Therefore, the applicability thereof can be determined based on the amount used and brazability.

Embodiment 5

In a refrigerant distributor 1 according to Embodiment 5, the basic configurations of junctions between the inflow pipe 4 and the inflow portion 5, the distributing portion 3 and the inflow portion 5, and the outflow pipes 2 and the outflow portions 3*a* are the same as those in the refrigerant distributor 1 according to Embodiment 3. So, the difference from the refrigerant distributor 1 according to Embodiment 3 will be mainly described.

The following method is used to deal with the use of a large number of distribution N using press working, which is a construction method having good workability, in Embodiment 5.

Figure 18:
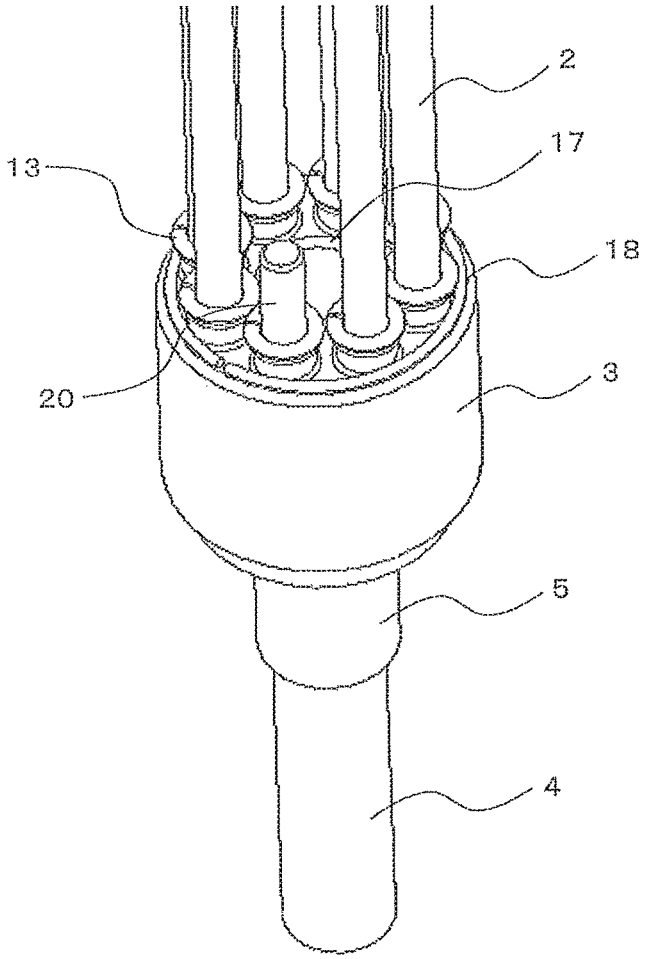
FIG. 18 is a perspective view showing the state before the brazing of a distributing portion 3, outflow pipes 2, and a plug 20 in a product in which the number of distribution N=7 according to Embodiment 5.

FIG. 18 is a perspective view showing the state before the brazing of a distributing portion 3, outflow pipes 2, and a plug 20 in a product in which the number of distribution N=7 according to Embodiment 5.

By performing ordinary burner brazing with one of the outflow portions 3*a* of the distributing portion 3 plugged by a plug 20, a number of distribution (for example, N=7) different from that in the press working stage (N=8) can be easily dealt with while utilizing the advantages of the distributing portion 3 such as press working, workability of brazing, and standardization, and applying the inexpensive distributing portion 3 together with the plug 20. To facilitate the aluminum brazing of the plug 20 and the outflow pipes 2, the heat capacity can be reduced by making the inflow portion 5 side end face of the plug 20 have a hollow shape.

Figure 19:
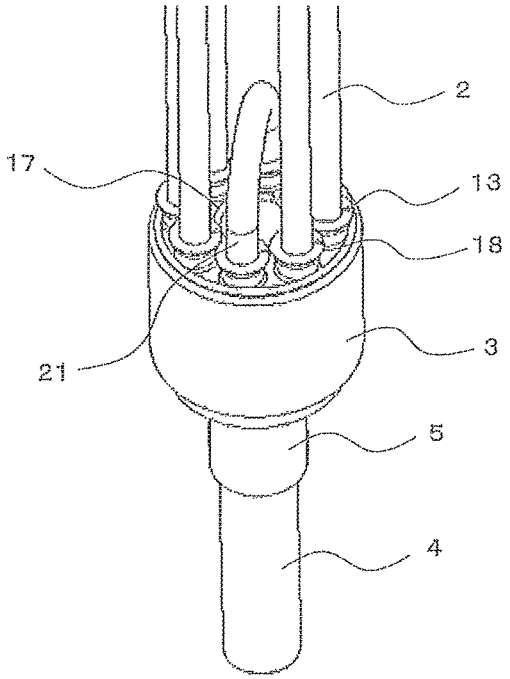
FIG. 19 is a perspective view showing the state before the brazing of a distributing portion 3, outflow pipes 2, and a bypass pipe 21 in a product in which the number of distribution N=6 according to Embodiment 5.

FIG. 19 is a perspective view showing the state before the brazing of a distributing portion 3, outflow pipes 2, and a bypass pipe 21 in a product in which the number of distribution N=6 according to Embodiment 5.

Figure 20:
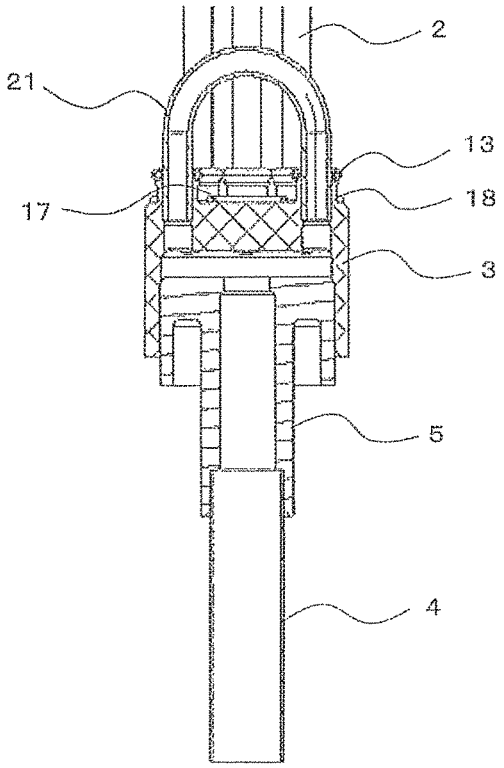
FIG. 20 is a sectional view showing the state before the brazing of a distributing portion 3, outflow pipes 2, and a bypass pipe 21 in a product in which the number of distribution N=6 according to Embodiment 5.

FIG. 20 is a sectional view showing the state before the brazing of a distributing portion 3, outflow pipes 2, and a bypass pipe 21 in a product in which the number of distribution N=6 according to Embodiment 5.

By performing ordinary burner brazing with two of the outflow portions 3*a* of the distributing portion 3 bypassed by a bypass pipe 21, similarly to the above, a number of distribution (for example, N=6) different from that in the press working stage (N=8) can be easily dealt with while utilizing the advantages of the distributing portion 3 such as press working, workability of brazing, and standardization, and applying the inexpensive distributing portion 3 together with the bypass pipe 21.

In Embodiment 5, examples are shown in which the distributing portion 3 of N=8 formed by press working is applied to products of N=7 and N=6. When the number of distribution of a product is a divisor of the number of distribution N in the press working stage, that is, N=2 or N=4 in this example, the rest are plugged by the above method in such a manner that they are evenly disposed. By doing so, substantially even distribution can be easily obtained by that configuration. In the case of other than a divisor, desired distribution performance design is possible by adjusting and designing the length of the outflow pipes 2 in advance, according to the pressure loss in each outflow portion 3*a* obtained in the plugged state, to secure even distribution, or by bypassing points, for example, on a diagonal with the bypass pipe 21, and thereby minimizing the influence of an uneven flow.

In all of the above embodiments, an example of a burner is shown as a method for brazing heating. However, the present invention is not limited to this as long as the features of the distributing portion 3 of the present invention can be utilized. Appropriate heating methods, such as hot air, a heater (sheathed heater, halogen heater), high-frequency induction heating, and an electric furnace, may be combined.

Although five assembly structure examples, Embodiments 1 to 5, have been shown, of course, the present invention is not limited to this as long as the features of the distributing portion 3 of the present invention can be utilized. When the present invention is applied to a combination structure with outflow pipes 2, an inflow portion 5, an inflow pipe 4, and a manifold, a similar effect can be expected.

In the above embodiments, cold forging-like press is used. However, the present invention is not necessarily limited to this construction method as long as the thick top plate portion 3*g* and the thin outflow portions 3*a* of the distributing portion 3 are integrally formed and the features of this example can be utilized. The cold forging-like press may be combined with machining or another processing method according to the object product.

Although the refrigerant distributors 1 according to Embodiments 1 to 5 have been described by taking an example in the case where the heat exchanger 100 functions as an evaporator, the present invention may be applied to the case where the heat exchanger 100 functions as a condenser. In this case, the refrigerant distributor 1 plays a role in distributing gas refrigerant flowing into the heat exchanger 100 to each heat transfer tubes 50.

The refrigerant distributors 1 according to Embodiments 1 to 5 are made of aluminum. Also in the case of a refrigerant distributor made of brass or copper, which has been heavily used in a conventional air-conditioning apparatus, the reduction of the heat capacity of the main body portion 3*b*, and the reduction of the heat capacity difference between the outflow portion 3*a* and the outflow pipes 2 are desirable in order to perform more reliable brazing. Therefore, a refrigerant distributor made of brass or copper can be formed using a press die similar to that for forming a refrigerant distributor made of aluminum, and a similar effect is exerted.

In recent years, for the purpose of pursuing energy saving, preventing ozone layer depletion, and preventing global warming, refrigerants operating at high pressure, such as R410A, R404A, R32, and $CO_2$, have tended to be used. Because, compared to the conventional HCFC refrigerant, the high pressure is high, or the low pressure is low, improvement in brazing accuracy has a lot of influence on the prevention of gas leak. According to the present invention, owing to appropriate heat input to members, stable brazing can be performed even by a non-skilled worker, and a refrigerant-leak-free high-quality refrigerant distributor can be provided.

The invention claimed is:

1. A refrigerant distributor comprising:

an inflow portion into which refrigerant flows from an inflow pipe; and a distributing portion configured to distribute refrigerant from the inflow portion to a plurality of outflow pipes, the distributing portion including:

a main body portion connected to the inflow portion, and a plurality of outflow portions connected to the outflow pipes, the outflow portions protruding from the main body portion, and being unitary with and formed integrally with the main body portion, such that a heat capacity difference between the outflow pipes and the distributing portion is small longitudinal axes of the plurality of outflow portions and a longitudinal axis of the main body portion are substantially parallel.

2. The refrigerant distributor of claim 1, wherein the distributing portion is formed by press working.

3. The refrigerant distributor of claim 1, wherein the main body portion is formed by drawing.

4. The refrigerant distributor of claim 1, wherein the main body portion has a cylindrical space communicating with outflow holes that open into the outflow portions, and wherein an inner periphery of the cylindrical space is configured so as to be in contact with inner peripheries of the outflow holes.

5. The refrigerant distributor of claim 1, wherein the distributing portion, the inflow portion, the outflow pipes, and the inflow pipe are made of aluminum, and wherein the outflow portions are brazed to the outflow pipes, the main body portion is brazed to the inflow portion, and the inflow portion is brazed to the inflow pipe.

6. The refrigerant distributor of claim 5, wherein an axial length of the outflow portions is equal to or greater than half of an axial brazing length of the outflow portions and the outflow pipes.

7. The refrigerant distributor of claim 1, wherein the outflow portions have a circular pipe shape, and an outside diameter and a wall thickness of the outflow portions are same as an outside diameter and a wall thickness of the outflow pipes.

8. The refrigerant distributor of claim 1, wherein the inflow portion has a cylindrical portion connected to the inflow pipe, and a disk portion connected to the main body portion, and the inflow pipe is disposed on an inner surface side of the cylindrical portion, wherein the disk portion is disposed on an inner surface side of the main body portion, and wherein one ends of the outflow portions are disposed on inner surface sides of expanded portions with which the outflow pipes are provided.

9. The refrigerant distributor of claim 1, wherein the inflow portion has a cylindrical portion connected to the inflow pipe, and a disk portion connected to the main body portion, wherein the inflow pipe is disposed on an outer surface side of the cylindrical portion, wherein a cylindrical rib on an inner surface side of which the main body portion is disposed is formed on an outer periphery of the disk portion, and wherein expanded portions on inner surface sides of which the outflow pipes are disposed are formed at the one ends of the outflow portions.

10. The refrigerant distributor of claim 1, wherein the outflow portions each have a circular pipe shape, an inside diameter of the outflow portions is substantially same as an outside diameter of the outflow pipes, and a wall thickness of the outflow portions is 1 to 2 times a wall thickness of the outflow pipes.

11. The refrigerant distributor of claim 1, wherein in outflow holes that open into the outflow portions, pipe stopper portions each having a diameter smaller than an inside diameter of the outflow holes are formed.

12. The refrigerant distributor of claim 1, wherein at the one ends of the outflow portions, flare portions that expand to outsides of the outflow portions are formed.

13. The refrigerant distributor of claim 1, wherein the inflow portion has a cylindrical portion connected to the inflow pipe, and an outer peripheral cylindrical portion connected to the main body portion, and the inflow pipe is disposed on an inner surface side of the cylindrical portion, wherein the outer peripheral cylindrical portion is disposed on an inner surface side of the main body portion, and wherein the one ends of the outflow pipes are disposed on inside diameter sides of the outflow portions.

14. The refrigerant distributor of claim 1, wherein brazing filler metal rings containing zinc are each disposed around the corresponding outflow portions, and, by heating the brazing filler metal rings, a sacrificial protection layer containing zinc is formed at least on an upper surface of the main body portion.

15. The refrigerant distributor of claim 14, wherein the brazing filler metal rings includes two rings, outer peripheral brazing filler metal rings disposed on outer side of a circumscribed circles of the plurality of outflow portions, and an inner peripheral brazing filler metal ring disposed on an inner side of an inscribed circle of the plurality of outflow portions.

16. The refrigerant distributor of claim 1, wherein a plug or a bypass pipe is attached to part of the plurality of outflow portions, and the part of the outflow portions is plugged.

17. The refrigerant distributor of claim 1, wherein the inflow portion has a throttle portion in which a cross-sectional area of a refrigerant flow passage is reduced.

18. A heat pump device comprising the refrigerant distributor of claim 1.

19. The refrigerant distributor of claim 1, wherein the distributing portion including the main body portion and the plurality of outflow portions is formed by press working, wherein the main body portion, which is connected to the inflow portion, has a cylindrical space communicating with outflow holes that open into the outflow portions which protrude from the main body portion, and wherein an inner periphery of the cylindrical space is configured so as to be in contact with inner peripheries of the outflow holes.

20. A refrigerant distributor comprising:

an inflow portion into which refrigerant flows from an inflow pipe; and a distributing portion configured to distribute the refrigerant from the inflow portion to a plurality of outflow pipes, the distributing portion including:

a main body portion that is connected to the inflow portion and that is provided with minute protrusions at regular intervals on a connection surface thereof, and a plurality of outflow portions that are connected to the outflow pipes and that are unitary with and integrally formed with, and protrude from, the main body portion, such that a heat capacity difference between the outflow pipes and the distributing portion is small longitudinal axes of the plurality of outflow portions and a longitudinal axis of the main body portion are substantially parallel.

* * * * *